US006120195A

United States Patent [19]

Nakano

[11] Patent Number: 6,120,195

[45] Date of Patent: Sep. 19, 2000

[54] METHOD FOR SUPPLYING WATER TO A TREATMENT LIQUID AND A PHOTO-DEVELOPING APPARATUS

[75] Inventor: Tsukasa Nakano, Wakayama, Japan

[73] Assignee: Noritsu Koki Co., Ltd., Wakayama-ken, Japan

[21] Appl. No.: 09/191,042

[22] Filed: Nov. 12, 1998

[30] Foreign Application Priority Data

Nov. 14, 1997 [JP] Japan ..... 9-313687

[51] Int. Cl.[7] ..... G03D 3/06

[52] U.S. Cl. ..... 396/626; 396/630

[58] Field of Search ..... 396/626, 630, 396/631, 578

[56] References Cited

U.S. PATENT DOCUMENTS

| | | | |
|---|---|---|---|
| 5,124,239 | 6/1992 | Fujita et al. | 430/398 |
| 5,177,521 | 1/1993 | Mogi et al. | 396/626 |
| 5,337,114 | 8/1994 | Mogi | 396/626 |
| 5,812,898 | 9/1998 | Benker et al. | 396/578 |
| 5,842,074 | 11/1998 | Nishida et al. | 396/578 |

FOREIGN PATENT DOCUMENTS

| | | |
|---|---|---|
| 0531234 | 3/1993 | European Pat. Off. . |
| 1281446 | 11/1989 | Japan . |
| 3249646 | 11/1991 | Japan . |
| 3280042 | 11/1991 | Japan . |

OTHER PUBLICATIONS

1) Patent Abstracts Of Japan, vol. 016, No. 105 (P–1325), Mar. 16, 1992 & JP 03 280042 A (Fuji Photo Film Co Ltd), Dec. 11, 1991.

2) Patent Abstracts Of Japan, vol. 014, No. 054 (P–0999), Jan. 31, 1990 & JP 01 281446 A, (Konica Corp), Nov. 13, 1989.

*Primary Examiner*—Alan A. Mathews

*Attorney, Agent, or Firm*—Jordan and Hamburg LLP

[57] ABSTRACT

When level sensors detect the fall of the levels of treatment liquids from standard levels to supply levels while a photo-developing apparatus having treatment tanks containing treatment liquids is in operation, water supply devices are activated to supply water to the standard levels in the respective treatment tanks. When the photo-developing apparatus is restarted after a suspended time, the water supply devices are activated to supply amounts of water corresponding to predicted evaporation amounts of the treatment liquids within a time set in relation to the suspended time. A sufficient development stability can be ensured by keeping the concentrations of the treatment liquids at proper values even at an operation starting point, such as when the photo-developing apparatus is restarted.

18 Claims, 6 Drawing Sheets

METHOD FOR SUPPLYING WATER TO A TREATMENT LIQUID AND A PHOTO-DEVELOPING APPARATUS

BACKGROUND OF THE INVENTION

The present invention relates to a method for supplying water to a treatment liquid when the levels of treatment liquids in treatment tanks of a photo-developing apparatus fall due to evaporation, and a photo-developing apparatus employing such a water supplying method.

In recent years, photo-developing apparatuses have been widely in use which automatically develop a photosensitive material such as a printing paper and a film by passing it through treatment tanks containing treatment liquids. In such photo-developing apparatuses, when the concentrations of the treatment liquids become dense due to the evaporation thereof during the operation, water is put into the treatment tanks to keep the concentrations of the treatment liquids at proper values (see Japanese Unexamined Patent Publications Nos. 1-281446, 3-249646, 3-280042). In other words, in order to keep the concentrations of the treatment liquids at proper values while the apparatus is in operation, the first publication No. 1-281446 discloses a technique for supplying water based on an actual amount of photosensitive material to be developed; the second publication No. 3-249646 discloses a technique for supplying treatment liquids after water is supplied; and the third publication No. 3-280042 discloses a technique for supplying water based on atmospheric temperature/humidity.

The evaporation of the treatment liquids in the photo-developing apparatus occurs not only when the photo-developing apparatus is in operation, but also after the operation is stopped, regardless of whether or not the developing operation is being performed. Accordingly, the developing operation may be started with the dense treatment liquids when the photo-developing apparatus is restarted after being suspended for a predetermined time or longer. Since only the concentrations of the treatment liquids during the operation are taken into consideration with the prior art techniques, a sufficient development stability may not be ensured at all points of time during the operation of the photo-developing apparatus including an operation starting time.

SUMMARY OF THE INVENTION

It is an object of the present invention to provide a method for supplying water to treatment liquids, and a photo-developing apparatus which have overcome the problems residing in the prior art.

According to an aspect of the invention, a water supplying method for supplying water to a treatment liquid, comprises the steps of: activating a water supplier to supply water to a treatment tank until a treatment liquid in the treatment tank reaches a standard level when a fall in the level of treatment liquid from the standard level to a specified supply level is detected while photo-developing is in operation; and activating the water supplier to supply an amount of water corresponding to a predicted evaporation amount of the treatment liquid before the photo-developing is restarted after being suspended.

According to another aspect of the invention, a photo-developing apparatus, comprises: a treatment tank which contains a treatment liquid; a level sensor which detects a level of the treatment liquid; a water supplier which supplies water into the treatment tank; and a controller which controls the water supplier, the controller activating the water supplier to supply water to a standard level of the treatment liquid in the treatment tank when the level sensor detects a fall in the level of treatment liquid from the standard level to a specified supply level while photo-developing is in operation, and activating the water supplier to supply an amount of water corresponding to a predicted evaporation amount of the treatment liquid before the photo-developing is restarted after being suspended.

These and other objects, features and advantages of the present invention will become more apparent upon a reading of the following detailed description and accompanying drawings.

BRIEF DESCRIPTION OF THE DRAWINGS

FIGS. 4A to 4C are diagrams showing a level sensing operation, wherein FIG. 4A shows a state where a treatment liquid is filled up to a standard level, FIG. 4B shows a state where the level of the treatment liquid falls to a supply level due to the evaporation thereof, and FIG. 4C shows a state where water is supplied up to a recovery level;

FIGS. 6A and 6B are diagrams showing a water supplying operation performed when level sensors detect the fall of the levels of the treatment liquids, wherein FIG. 6A shows a state where water is supplied from the supply level to the recovery level and FIG. 6B shows a state where water is supplied from the recovery level to the standard level.

DETAILED DESCRIPTION OF THE PREFERRED EMBODIMENTS OF THE INVENTION

Figure 1:
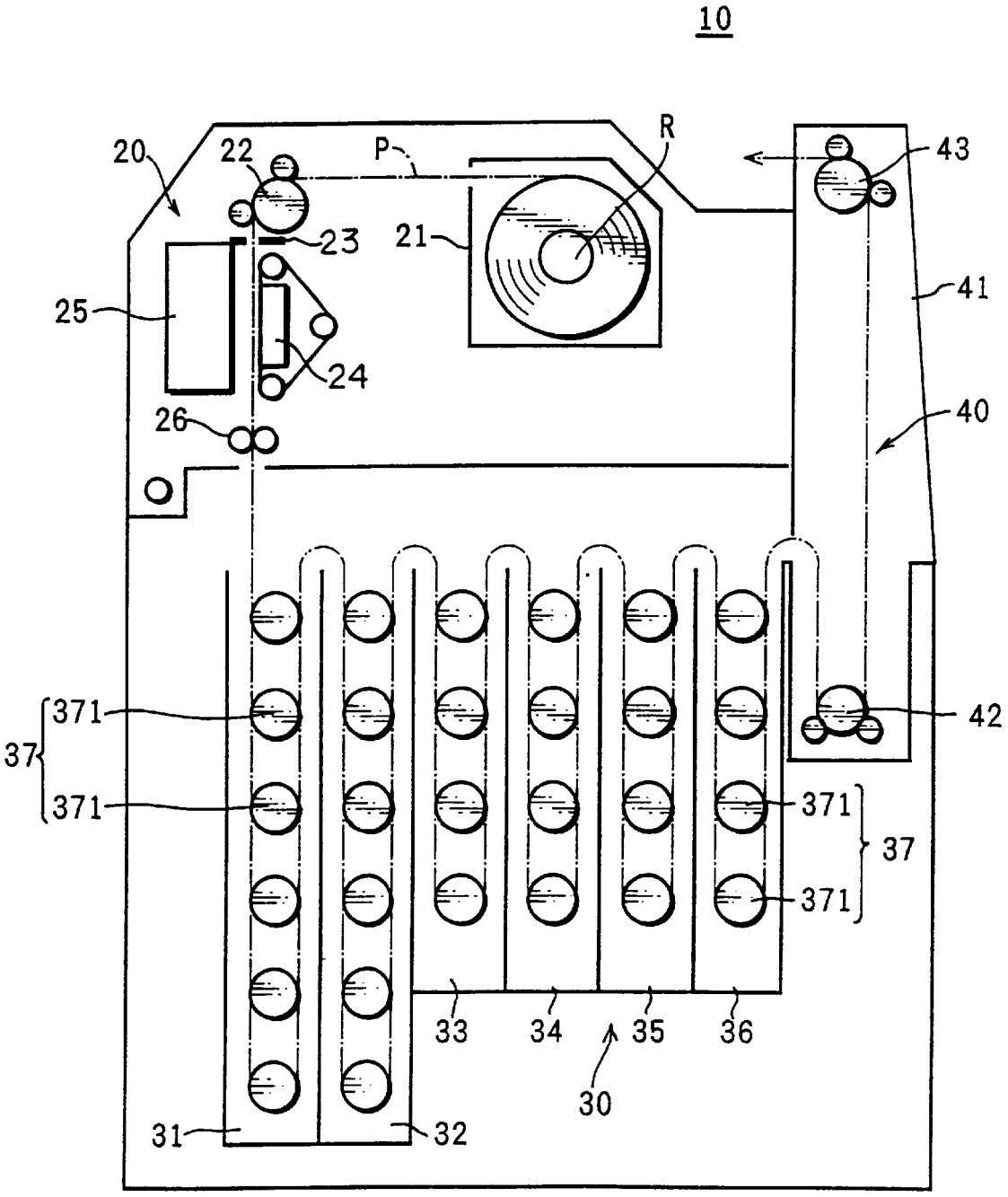
FIG. 1 is a schematic construction diagram of a photo-developing apparatus employing embodying the invention.

FIG. 1 is a schematic construction diagram of a photo-developing apparatus embodying the invention. In FIG. 1, a photo-developing apparatus 10 is provided with an exposure unit 20 located at an upper part, a developing unit 30 located at a lower part and a drying unit 40 located at a front part.

The exposure unit 20 includes a magazine 21, a pair of transport rollers 22, a cutter 23, a suction unit 24, a film image projector 25, and a pair of transport rollers 26. The magazine 21 contains a photosensitive material P which is a long printing paper rolled on a roller R. The pair of transport rollers 22 transport the photosensitive material P dispensed from the magazine 21 toward a downstream side. The cutter 23 cuts the photosensitive material P to a specified length. The suction unit 24 holds the photosensitive material P by suction. The film image projector 25 projects a film image onto the photosensitive material P held by the suction unit 24 by exposing the photosensitive material P. The pair of transport rollers 26 transport the exposed photosensitive material P to the developing unit 30 arranged at a downstream side.

The developing unit 30 includes a developer tank 31 containing developer, a bleach fixer tank 32 containing bleach fixer, first, second, third and fourth stabilizer tank 33, 34, 35, 36 containing stabilizer. The tanks 31 to 36 are arranged one after another and have a transport roller unit 37 comprised of a plurality of transport rollers 371 provided therein. The exposed photosensitive material P is transported from the upstream side to the downstream side by the transport roller unit 37 while passing through the developer, bleach fixer and stabilizer. The detailed construction of the developing unit 30 is described later.

The drying unit 40 includes an unillustrated heater provided in a drying chamber 41 and an unillustrated fan or the like for feeding a heat of the heater into the drying chamber 41. The photosensitive material P having passed through the drying chamber 41 is discharged to the outside by pairs of transport rollers 42, 43.

Figure 2:
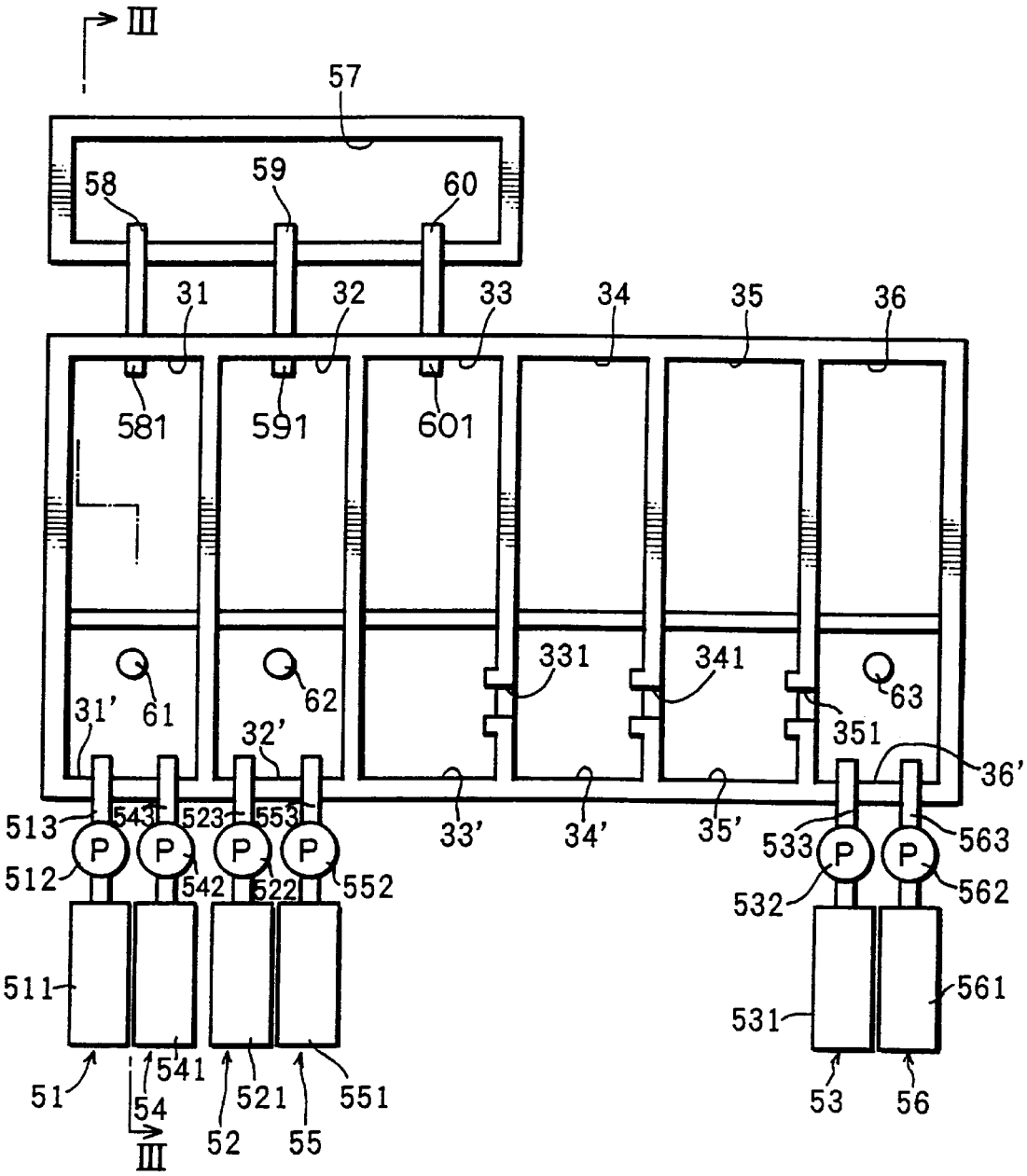
FIG. 2 is a plan view of a developing unit of the photo-developing apparatus.
Figure 3:
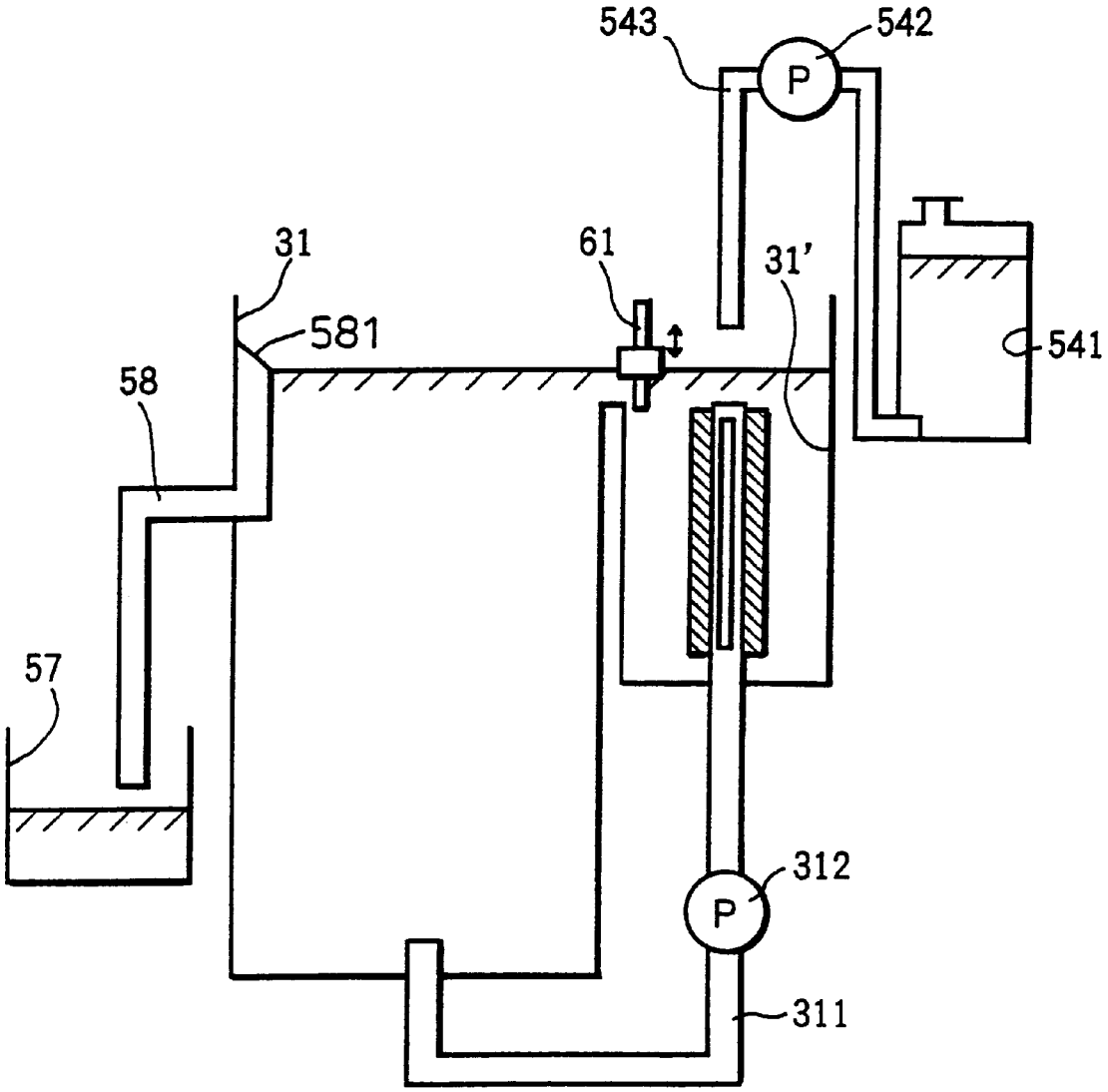
FIG. 3 is a section of the developing unit taken along the line III—III in FIG. 2.

FIG. 2 is a plan view showing an essential portion of the developing unit 30, and FIG. 3 is a vertical section along the line III—III in FIG. 2. In FIGS. 2 and 3, the respective tanks 31, 32, 33, 34, 35, 36 are open in their upper surfaces, and an auxiliary developer tank 31' containing developer, an auxiliary bleach fixer tank 32' containing bleach fixer, first, second, third and fourth auxiliary stabilizer tanks 33', 34', 35', 36' containing stabilizer are arranged on one side of the tanks 31, 32, 33, 34, 35, 36.

The respective auxiliary tanks 31' to 36' construct parts of the tanks 31 to 36, and are open in their upper surfaces like the tanks 31 to 36. Liquid paths 331, 341, 351 are formed at the upper ends of the first to fourth auxiliary stabilizer tanks 33' to 36' between adjacent ones of them.

The developer tank 31 and the auxiliary developer tank 31' are connected via a liquid supply pipe 311 arranged at the bottom. The treatment liquid in the auxiliary developer tank 31' is supplied into the developer tank 31 via a circulation pipe 312, so that the treatment liquid circulates between the developer tank 31 and the auxiliary developer tank 31'. The other tanks 32 to 36 and the other auxiliary tanks 32' to 36' are also similarly constructed.

The auxiliary developer tank 31', the auxiliary bleach fixer tank 32' and the fourth auxiliary stabilizer tank 36' are provided with liquid supply devices 51, 52, 53 for supplying the treatment liquids, respectively. These liquid supply devices 51, 52, 53 are adapted to replenish the treatment tanks with new treatment liquids every time a specified amount of photosensitive material P is developed since the performance of the treatment liquids are gradually degraded as more and more photosensitive material P is developed.

The liquid supply device 51 is constructed such that a treatment liquid filled in a replenish tank 511 is supplied into a first pump 512 via a supply pipe 513. The liquid supply device 52 is constructed such that a treatment liquid filled in a replenish tank 521 is supplied into a second pump 522 via a supply pipe 523. The liquid supply device 53 is constructed such that a treatment liquid filled in a replenish tank 531 is supplied into a third pump 532 via a supply pipe 533.

The auxiliary developer tank 31', the auxiliary bleach fixer tank 32' and the fourth auxiliary stabilizer tank 36' are also provided with water supply devices 54, 55, 56 for supplying water, respectively. These water supply devices 54, 55, 56 are adapted to add water into the treatment tanks 31, 32, 36 to keep the concentrations of the respective treatment liquids at specified levels since the respective treatment liquids (precisely water or moisture in the treatment liquids) evaporate over time, thereby making the concentrations thereof denser. The water supply devices 54, 55, 56 may be each comprised of two water supply devices: a first water supply device (which is operated when level sensors 61, 62, 63 to be described later detect the fall of the levels) and a second water supply device (which is operated to return the level of the treatment liquid in the treatment tank to the standard level when the photo-developing apparatus is restarted). In this manner, the water supply devices 54, 55, 56 each serve both as a first water supply device and as a second water supply device.

The water supply device 54 is operated such that water in a water tank 541 is supplied via a supply pipe 543 by a fourth pump 542. The water supply device 55 is operated such that water in a water tank 551 is supplied via a supply pipe 553 by a fifth pump 552. The water supply device 56 is operated such that water in a water tank 561 is supplied via a supply pipe 563 by a sixth pump 562.

A waste liquid tank 57 is provided adjacent to the developer tank 31, the bleach fixer tank 32 and the first stabilizer tank 33. The waste liquids, which are overflown from the upper ends of the treatment tanks 31, 32, 33 by supplying the treatment liquids to the treatment tanks 31, 32, 36 via the liquid supplier 51, 52, 53, are discharged into the waste liquid tank 57 via waste liquid pipes 58, 59, 60, and stored therein. Accordingly, the levels of the respective treatment liquids in the treatment tanks 31, 32, 33, 34, 35, 36 are specified by inlets 581, 591, 601 of the waste liquid pipes 58, 59, 60 located at the upper ends of the treatment tanks 31, 32, 33. In other words, the positions of the inlets 581, 591, 601 of the waste liquid pipes 58, 59, 60 are the standard levels of the respective treatment liquids.

Level sensors 61, 62, 63 for detecting the levels of the respective treatment liquids are provided in the auxiliary developer tank 31', the auxiliary bleach fixer tank 32' and the fourth auxiliary stabilizer tank 36'. These level sensors 61, 62, 63 are, as shown in FIG. 4, constructed by fitting floats 612, 622, 632 mounted with a magnet into tubular elements 611, 621, 631 having a switching contact SS provided therein. The floats 612, 622, 632 move upward and downward according to the levels of the treatment liquids, thereby magnetically opening and closing the switching contacts SS in the tubular elements 611, 621, 631.

Figure 4A:
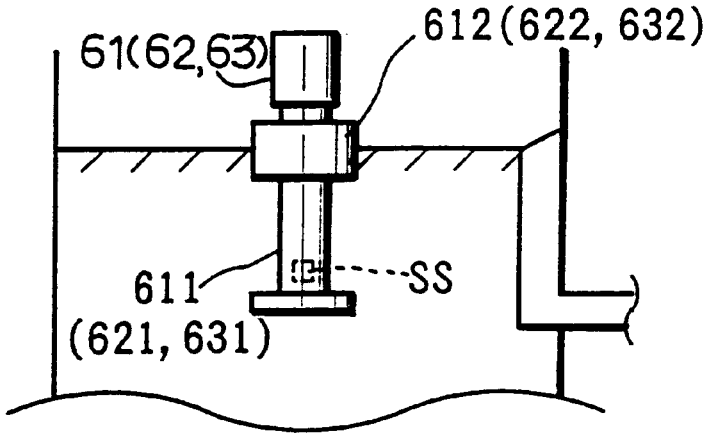

These level sensors 61, 62, 63 are such that the floats 612, 622, 632 are located above the switching contacts SS in the tubular elements 611, 621, 631 when the treatment liquids are filled up to the standard levels as shown in FIG. 4A. At this time, the switching contacts SS are, for example, open. When the levels of the treatment liquids fall by a distance d1 to the positions of the switching contacts SS due to the evaporation thereof, the floats 612, 622, 632 also move to the positions of the switching contacts SS. At this time, the switching contacts SS are, for example, closed. In other words, the state of the switching contact SS does not change until the level of the treatment liquid changes from the standard position shown in FIG. 4A to the position shown in FIG. 4B located below the standard position by the distance d1.

Figure 4B:
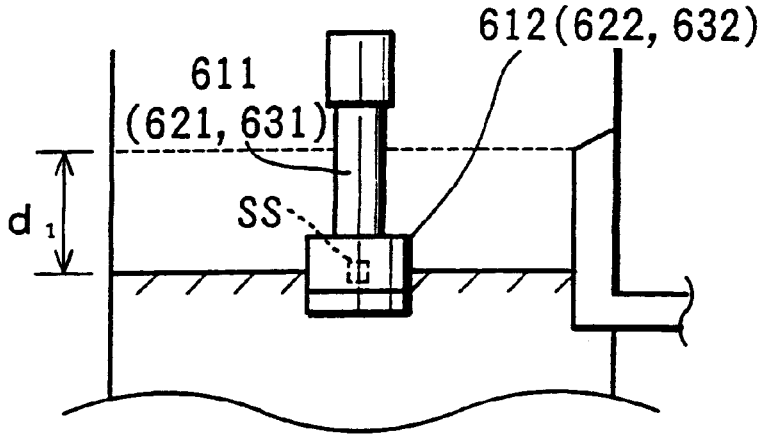
Figure 4C:
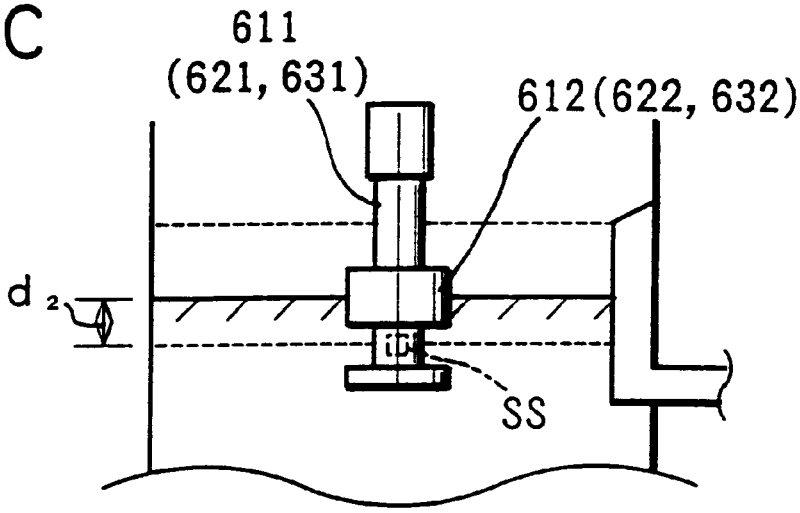

When the states of the switching contacts SS change in the position shown in FIG. 4B, the pumps 542, 552, 562 of the respective water supply devices 54, 55, 56 are operated to supply water from the water supply tanks 541, 551, 561. In other words, the position shown in FIG. 4B where the state of the switching contact SS changes is a supply level where the supply of the treatment liquid is started. When the level rises by a distance d2 (where d2<d1) from the position shown in FIG. 4B to a position shown in FIG. 4C, the floats 612, 622, 632 also move upward, thereby changing the states of the switching contacts SS from the closed states to the open states. The level sensors 61, 62, 63 are so arranged as to operate as above because of a likelihood that the level might not be detected due to variations in sensitivity and degree of horizontality of the treatment tanks if the level sensors 61, 62, 63 were arranged such that the switching contacts SS come to the levels shown in FIG. 4A.

Figure 5:
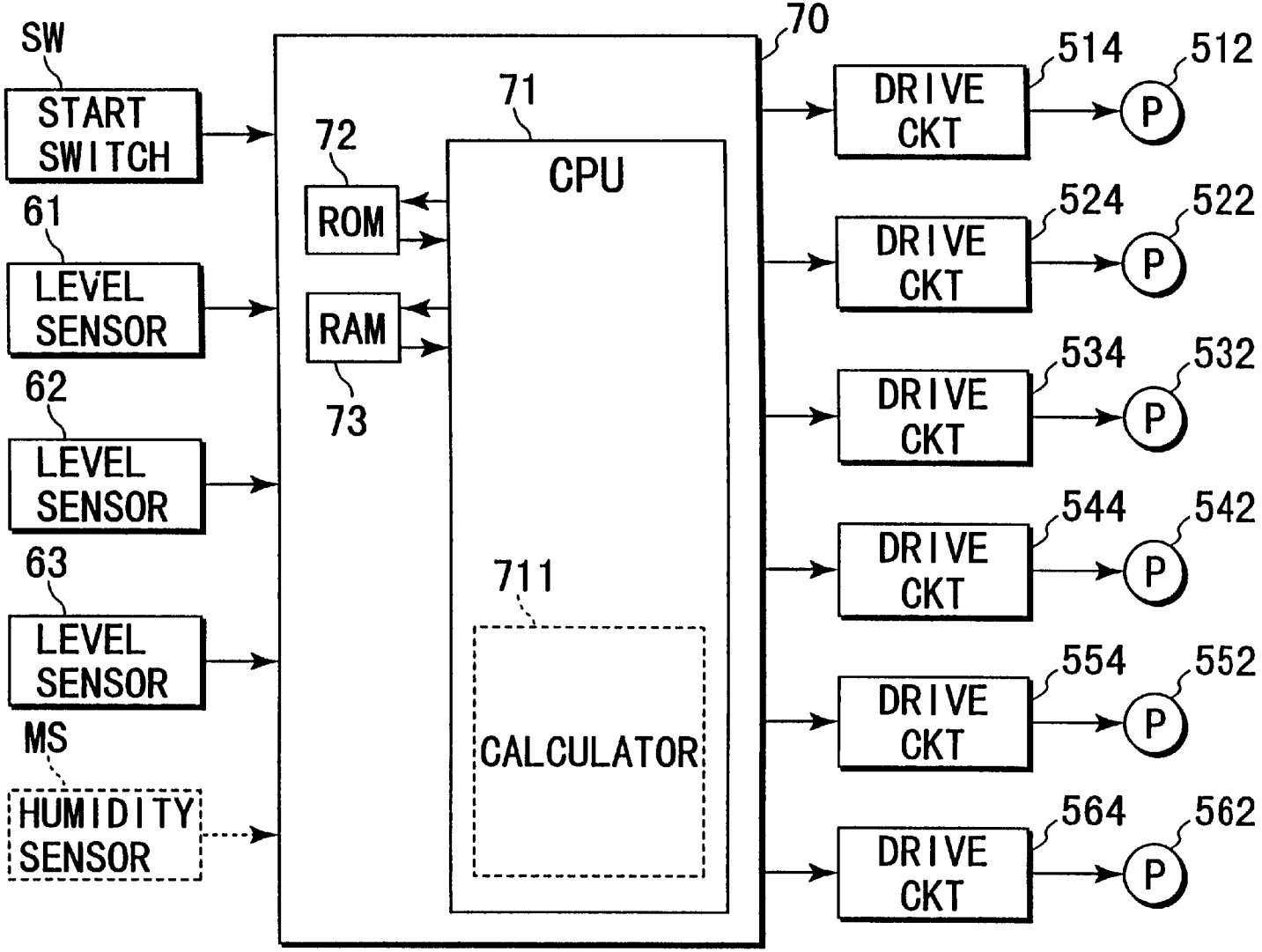
FIG. 5 is a schematic construction diagram of a control system of the developing unit of the photo-developing apparatus.

FIG. 5 is a schematic construction diagram of a control system of the developing unit 30. In FIG. 5, a controller 70 is comprised of a CPU 71 for performing specified calculations, a ROM 72 for storing a program for a specified processing, and a RAM 73 for temporarily storing data.

The controller 70 is connected with a start switch SW for starting the photo-developing apparatus, the level sensor 61 in the auxiliary developer tank 31', the level sensor 62 in the auxiliary bleach fixer tank 32' and the level sensor 63 in the fourth auxiliary stabilizer tank 36', so that specified detection signals can be inputted to the controller 70. The controller 70 is also connected with a drive circuit 514 for driving the first pump 512 of the liquid supply device 51, a drive circuit 524 for driving the second pump 522 of the liquid supply device 52, and a drive circuit 534 for driving the third pump 532 of the liquid supply device 53, a drive circuit 544 for driving the fourth pump 542 of the water supply device 54, a drive circuit 554 for driving the fifth pump 552 of the water supply device 55, and a drive circuit 564 for driving the sixth pump 562 of the water supply device 56, so as to control the operations of the respective drive circuits.

The photo-developing apparatus 10 employing the above-described water supplying method operates as follows.

[First Manner]

When the start switch SW is turned on, the film images are successively projected onto the photosensitive material P by the exposure unit 20, and the projected film images are developed in the developing unit 30. The performance of the respective treatment liquids is degraded as more and more photosensitive material P is treated. When a specified amount of the photosensitive material P is treated, the first, second and third pumps 512, 522, 532 of the liquid supply devices 51, 52, 53 operate to supply specified quantities of treatment liquids into the auxiliary treatment tanks 31' 32', 36' from the replenish tanks 511, 521, 531. Upon the supply of the treatment liquids, the overflown treatment liquids (waste liquids) are discharged into the waster liquid tank 57 from the treatment tanks 31, 32, 33. The liquid supply devices 51, 52, 53 may simultaneously operate or may individually operate according to the level of the corresponding liquids. Whether or not a specified amount of the photosensitive material P has already been developed is controlled based on the length or area of the photosensitive material P developed.

Since the treatment liquids in the treatment tanks 31, 32, 33, 34, 35, 36 are kept at a specified temperature (e.g. about 30° C.) during the operation of the photo-developing apparatus 10, they are more likely to evaporate than when the photo-developing apparatus 10 is not in operation. When the levels of the treatment liquids fall to the supply levels shown in FIG. 4B upon the lapse of a specified time, the level sensors 61, 62, 63 detect the fall of the levels and the fourth, fifth and sixth pumps 542, 552, 562 of the water supply devices 54, 55, 56 operate to supply water into the auxiliary treatment tanks 31', 32', 36' from the water tanks 541, 551, 561. The water supply devices 54, 55, 56 may simultaneously operate or may individually operate according to the levels of the corresponding liquids.

Figure 6A:
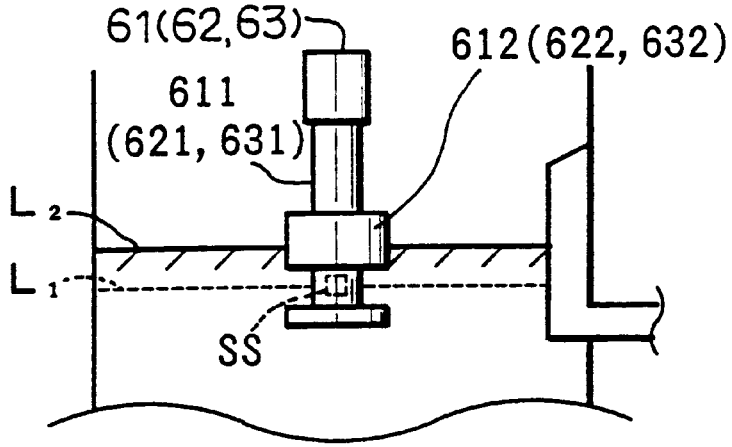
Figure 6B:
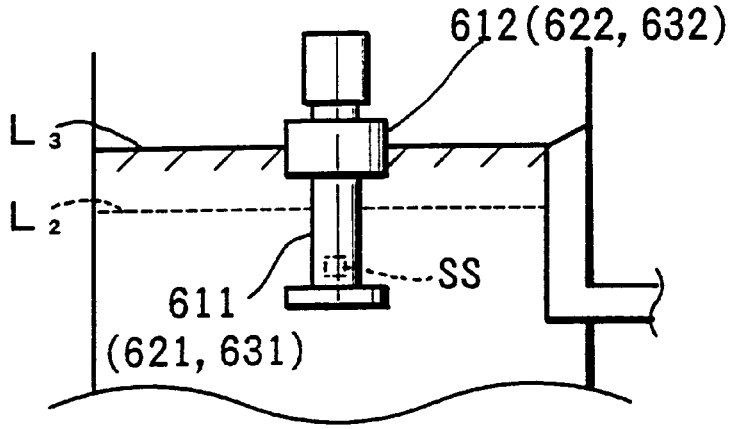

The supply of water is performed in two steps in this manner. First, in the first step, water is supplied so that the levels of the treatment liquids rise from a supply level L1 where the states of the switching contacts SS of the level sensors 61, 62, 63 are changed to a level L2 where the states of the switching contacts SS are inverted as shown in FIG. 6A. At this time, the water supply devices 54, 55, 56 are temporarily stopped. In the second step, the water supply devices 54, 55, 56 are restarted to supply water so that the levels of the treatment liquids rise from the level L2 to the standard level L3 as shown in FIG. 68. The counting of time is started when the states of the switching contacts SS change at the level L2, and the fourth, fifth and sixth pumps 542, 552, 562 are driven for a specified period to supply water. Instead of dividing the supply of water into two steps, the time may be counted from the supply level L1, and water may be continuously supplied up to the standard level L3 by driving the fourth, fifth and sixth pumps 542, 552, 562 for a specified period.

As described above, during the operation of the photo-developing apparatus 10, the level sensors 61, 62, 63 detect the fall of the levels of the treatment liquids caused by the evaporation thereof and the water supply devices 54, 55, 56 operate to supply water from the supply level to the standard level. Therefore, the concentrations of the respective treatment liquids can be kept at substantially constant values.

On the other hand, when the operation of the photo-developing apparatus 10 is stopped, the treatment liquids evaporate to a less degree than when the photo-developing apparatus 10 is in operation since the temperatures of the respective treatment liquids fall. However, a specified amount of the treatment liquid continues to evaporate according to an ambient humidity or the like. For example, when the photo-developing apparatus, which was stopped at the closing time of work in the evening one day before, is restarted at the starting time on the next day, the levels of the treatment liquids are fallen below the standard levels due to the evaporation between the closing time and the starting time, i.e. the treatment liquids have denser concentrations. In view of this, the levels of the respective treatment liquids at the restart of the photo-developing apparatus 10 are returned at least to the levels when the photo-developing apparatus 10 was stopped at the closing time of work by a method described below. While the photo-developing apparatus 10 is not in operation, the treatment liquids do not normally evaporate to the extent that the levels thereof fall to the supply levels where the level sensors 61, 62, 63 detect the fall of the levels.

TABLE-1 shows amounts of the treatment liquids in the respective treatment tanks 31, 32, 33, 34, 35, 36 evaporated during a suspended time of the photo-developing apparatus 10 from the closing time of work to the starting time (e.g. 12 hours from the evening to the following morning).

TABLE 1

| Treatment Tank | Predicted Evaporation Amount (cc) |
|---|---|
| Developer Tank | 62 |
| Bleach Fixer Tank | 37 |
| 1st Stabilizer Tank | 25 |
| 2nd Stabilizer Tank | 26 |
| 3rd Stabilizer Tank | 42 |
| 4th Stabilizer Tank | 100 |

The evaporation amounts shown in TABLE-1 are values empirically obtained under environmental conditions: temperature of about 20° C. and humidity of about 50% RH (both values are average values during a period from the closing time to the starting time) in a place where the photo-developing apparatus 10 is set. In this manner, the values shown in TABLE-1 are stored in the ROM 72 as predicted evaporation values in the case that the suspended time is 12 hours. The data are read from the ROM 72 when the start switch SW is turned on at the starting time on the following morning, and the water supply devices 54, 55, 56 are activated to automatically supply amounts of water corresponding to the predicted evaporation amounts shown in TABLE-1 into the respective treatment tanks 31, 32, 33, 34, 35, 36. For the treatment tanks 33, 34, 35, 36 containing the stabilizer liquid, an amount of water corresponding to a total value of the values thereof stored in the ROM 72 is supplied into the treatment tank 36.

In this manner, the suspended time is fixedly set at 12 hours, and the amounts of water corresponding to the predicted evaporation amounts shown in TABLE-1 are supplied when the start switch SW is turned on at the starting time even if the starting time were slightly shifted. Average predicted evaporation amounts per hour can be obtained by dividing the values shown in TABLE-1 by 12. A plurality of suspended times (e.g. 8 hours, 12 hours, 14 hours) may be set based on the predicted evaporation amounts per hour, and the suspended time approximate to an actual suspended time may be selected. If a plurality of suspended times are set, it is particularly advantageous in the case that the suspended time of the photo-developing apparatus 10 differs depending on the day. Although the suspended times stored in the ROM 72 may correspond with the actual suspended time, it may not be necessary to precisely correspond therewith in controlling the apparatus 10. Therefore, this time is referred to as a set time in relation to the suspended time.

When the photo-developing apparatus 10 is restarted after the suspended time, the water supply devices 54, 55, 56 are activated to supply amounts of water corresponding to the predicted evaporation amounts within the set time. Accordingly, the levels of the treatment liquids at the restarting time are returned to the levels when the photo-developing apparatus 10 was stopped at the end of work, so that the concentration of the liquids when the developing operation is restarted is not higher than necessary. If the actual evaporation amounts exceed the predicted evaporation amounts and the levels of the liquids fall below the supply levels where the level sensors 61, 62, 63 detect the fall of the levels, the water supply devices 54, 55, 56 may be activated in response to the detection signals outputted from the level sensors 61, 62, 63.

[Second Manner]

A second manner differs from the first manner in the following point. Unlike the first manner in which amounts of water corresponding to the predicted evaporation amounts of the treatment liquids within the time set in relation to the suspended time of the photo-developing apparatus 10 are supplied when the photo-developing apparatus is restarted after the suspended time, amounts of water corresponding to predicted evaporation amounts during a specified interval are supplied at the specified intervals until the photo-developing apparatus 10 is restarted after being stopped in the second manner.

Predicted evaporation amounts of the treatment liquids per unit time during the suspended time of the photo-developing apparatus 10 can be obtained from TABLE-1. In this manner, the specified interval is counted after the suspended time is started and the water supply devices 54, 55, 56 are activated every specified interval (e.g. every two hours) to supply amounts of water corresponding to the predicted evaporation amounts during this interval. In this way, when the photo-developing apparatus 10 is restarted, the levels of the respective treatment liquids are returned to the levels when the photo-developing apparatus 10 is stopped at the end of work, so that the concentration of the liquids when the developing operation is restarted is not higher than necessary. The interval at which water is supplied (i.e. at which the water supply devices 54, 55, 56 are activated) can be desirably set.

Although water is supplied at the specified intervals in the second manner, amounts of water corresponding to products of predicted evaporation amounts during the specified intervals and the specified intervals counted during the suspended time may be supplied when the photo-developing apparatus 10 is restarted. In other words, the specified interval is continuously counted after the suspended time is started, and amounts of water corresponding to the predicted evaporation amounts obtained by multiplying the predicted evaporation amounts during the specified interval by the counted result up to the restarting time may be supplied when the start switch SW is turned on.

The water supplying method and the photo-developing apparatus 10 employing such a method may be embodied in the following various manners.

(1) Although the levels of the treatment liquids are returned to (or approximately to) the level when the photo-developing apparatus 10 is stopped in the foregoing embodiments, the water supply devices 54, 55, 56 may be activated when the photo-developing apparatus 10 is stopped to supply amounts of water corresponding to the evaporation amounts from the standard levels, so that the levels of the treatment liquids are at the standard levels when the photo-developing apparatus 10 is restarted. In such a case, the levels of the respective treatment liquids are returned to (or approximately to) the standard levels when the photo-developing apparatus 10 is restarted, with the result that the concentrations of the liquids can be proper when the developing operation is restarted. The levels of the treatment liquids may, for example, be returned to the standard levels as follows when the photo-developing apparatus 10 is stopped. Predicted evaporation amounts per unit time of the respective treatment liquids during the operation of the photo-developing apparatus 10 are empirically obtained and amounts of water to be supplied are calculated by multiplying these predicted evaporation amounts per unit time by the number of unit time counted based on the detection signals of the level sensors 61, 62, 63 immediately before the photo-developing apparatus 10 is stopped.

(2) In the foregoing embodiments, the levels of the treatment liquids are returned to the levels when the suspended time is started or to the standard levels when the photo-developing apparatus 10 is restarted by reading the data of TABLE-1 stored in the ROM 72. However, an operational expression for calculating an amount of water to be supplied using time as a variable may be obtained for each treatment tank based on TABLE-1 and stored in the ROM 72, and amounts of water to be supplied may be calculated in accordance with these operational expressions. In such a case, the CPU 71 may be provided with a function of a water supply amount calculator 711 (shown by dotted line in FIG. 5).

(3) In the foregoing embodiments, the predicated evaporation amounts at a constant ambient humidity are empirically obtained in order to return the levels of the treatment liquids to the levels when the suspended time is started or to the standard levels when the photo-developing apparatus 10 is restarted. However, a humidity sensor MS (indicated by dotted line in FIG. 5) may be provided around the photo-developing apparatus 10, and the predicted evaporation amounts may be obtained based on a humidity (relative humidity) data detected by this humidity sensor. In such a case, relationships between humidity and evaporation amounts per unit time are empirically obtained; operational expressions for calculating the predicted evaporation amounts using humidity and time as variables are obtained from the empirical data and stored in the ROM 72; and the predicted evaporation amounts are calculated based on the humidity detected by the humidity sensor MS. This enables a more precise control of the concentrations of the treatment liquids.

(4) Although the invention is applied to the photo-developing apparatus for developing the printing paper as a photosensitive material in the foregoing embodiments, it may be applicable to an apparatus for developing a film as a photosensitive material or an apparatus having both a printing paper developing function and a film developing function.

As described above, the water supplier is activated to supply water to a treatment tank until a treatment liquid in the treatment tank reaches to a standard level when a fall in the level of treatment liquid from the standard level to a specified supply level is detected while photo-developing is in operation. The water supplier is activated to supply an amount of water corresponding to a predicted evaporation amount of the treatment liquid before the photo-developing is restarted after being suspended.

The water supplier may be activated immediately before the photo-developing is restarted, the predicted evaporation amount being obtained based on a suspended time of the photo-developing. The predicted evaporation may be obtained based on an unit evaporation amount of the treatment liquid per an interval and the number of occurrences of interval from start of suspension to restart.

The water supplier may be activated a plurality of times at a specified interval before the photo-developing is restarted. The predicted evaporation amount may be obtained based on a time of the specified interval.

The predicted evaporation amount may be obtained based on a correspondence between an ambient humidity of the treatment tank and an evaporation amount of the treatment liquid.

The water supplier may be constructed by a first water supplying portion which supplies water to the treatment tank when the photo-developing is in operation, and a second water supplying portion which supplies water to the treatment tank before the photo-developing is restarted after being suspended.

According to the method, if the suspended time is 12 hours, for example, the amount of the treatment liquid which evaporate during 12 hours are confirmed by an experiment or the like and the amount of water corresponding to the predicted evaporation amounts are supplied. The time for prediction may be fixed or selected from several times, and does not necessarily precisely correspond with an actual suspended time. Even if the time is 10 hours although an actual suspended time is, for example, between 10 hours and 14 hours, the concentration of the treatment liquid do not largely change.

The photo-developing operation can be started with the treatment liquid of a suitable concentration when the photo-developing apparatus is restarted by supplying the predicted evaporation amount during one or several hours or by collectively supplying an amount of water corresponding to a product of a predicted evaporation amount per an interval (e.g., one hour) and the number of occurrences of intervals.

The predicted evaporation amount corresponding to the environment where the photo-developing apparatus is installed can be obtained, and the concentration of the treatment liquid can be highly precisely kept at a proper value by supplying a proper amount of water.

Accordingly, a sufficient development stability can be ensured by keeping the concentration of the treatment liquid at a proper value even at an operation starting point, such as when the photo-developing is restarted.

The photo-developing apparatus is provided with a treatment tank operable to contain a treatment liquid, a level sensor for detecting a level of the treatment liquid, a water supplier for supplying water into the treatment tank, and a controller for controlling the water supplier. The controller activates the water supplier to supply water to a standard level of the treatment liquid in the treatment tank when the level sensor detects a fall in the level of treatment liquid from the standard level to a specified supply level while photo-developing is in operation, and activating the water supplier to supply an amount of water corresponding to a predicted evaporation amount of the treatment liquid before the photo-developing is restarted after being suspended.

The controller may activate the water supplier immediately before the photo-developing is restarted, the predicted evaporation amount being obtained based on a suspended time of the photo-developing. The predicted evaporation may be obtained based on an unit evaporation amount of the treatment liquid per an interval and the number of occurrences of interval from start of suspension to restart.

The controller may activate the water supplier a plurality of times at a specified interval before the photo-developing is restarted.

According to the above apparatus, when the level sensor detects a fall of the level while the photo-developing is in operation, the water supplier supplies water to the standard level of the treatment tank. On the other hand, when the photo-developing is restarted after the suspended time, the water supplier supplies an amount of water corresponding to the predicted evaporation amount of the treatment liquid.

Thus, a sufficient development stability can be ensured by keeping the concentration of the treatment liquid at a proper value even at an operation starting point, such as when the photo-developing is restarted.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A water supplying method for supplying water to a treatment liquid, comprising the steps of:

preparing a table including a predicted water evaporation amount of the treatment liquid per a specified time period under a non photo-developing operation state;

activating a water supplier to supply water to a treatment tank until a treatment liquid in the treatment tank reaches to a standard level when a fall in the level of treatment liquid from the standard level to a specified supply level is detected while photo-developing is in operation; and activating the water supplier to supply an amount of water corresponding to the predicted evaporation amount of the treatment liquid in the table before the photo-developing is restarted after being suspended.

2. A water supplying method according to claim 1, wherein the water supplier is activated immediately before the photo-developing is restarted, the predicted evaporation amount being obtained based on a suspended time of the photo-developing.

3. A water supplying method according to claim 2, wherein the predicted evaporation is obtained based on an unit evaporation amount of the treatment liquid per an interval and the number of occurrences of interval from start of suspension to restart.

4. A water supplying method according to claim 1, wherein the water supplier is activated a plurality of times at a specified interval before the photo-developing is restarted.

5. A water supplying method according to claim 4, wherein the predicted evaporation amount is obtained based on a time of the specified interval.

6. A water supplying method according to claim 1, wherein the predicted evaporation amount is obtained based on a correspondence between an ambient humidity of the treatment tank and an evaporation amount of the treatment liquid.

7. A water supplying method according to claim 1, wherein the table is stored in a ROM and the predicted water evaporation amount is obtained by reading the table in the ROM when a start switch is turned on to resume the photo-developing operation.

8. A water supplying method according to claim 7, wherein the data in the table contains the predicted water evaporation amount of the treatment liquid which was measured under a normal non-operation state.

9. A water supplying method according to claim 8, wherein the data in the table contains the predicted water evaporation amount per a unit time period, and the method further comprising:

measuring a suspension time from a time that a previous photo-developing operation was suspended until a next photo-developing operation is resumed; and when activating the water supplier at the time of resuming said next photo-developing operation, calculating the supply amount of the water based upon the measured suspension time and the predicted water evaporation amount per said unit time period.

10. A water supplying method for supplying water to a treatment liquid, comprising the steps of:

activating a water supplier to supply water to a treatment tank until a treatment liquid in the treatment tank reaches to a standard level when a fall in the level of treatment liquid from the standard level to a specified supply level is detected while photo-developing is in operation; and activating the water supplier to supply an amount of water corresponding to a predicted evaporation amount of the treatment liquid before the photo-developing is restarted after being suspended;

said water supplier including a first water supplying portion which supplies water to the treatment tank when the photo-developing is in operation, and a second water supplying portion which supplies water to the treatment tank before the photo-developing is restarted after being suspended.

11. A photo-developing apparatus, comprising:

a treatment tank which contains a treatment liquid;

a level sensor which detects a level of the treatment liquid;

a water supplier which supplies water into the treatment tank; and a controller which stores a table including a predicted water evaporation amount of the treatment liquid per a specified time period under a non photo-developing operation state and which controls the water supplier, the controller activating the water supplier to supply water to a standard level of the treatment liquid in the treatment tank when the level sensor detects a fall in the level of treatment liquid from the standard level to a specified supply level while photo-developing is in operation, and activating the water supplier to supply an amount of water corresponding to the predicted evaporation amount of the treatment liquid in said table before the photo-developing is restarted after being suspended.

12. A photo-developing apparatus according to claim 11, wherein the controller activates the water supplier immediately before the photo-developing is restarted, the predicted evaporation amount being obtained based on a suspended time of the photo-developing.

13. A photo-developing apparatus according to claim 12, wherein the predicted evaporation is obtained based on an unit evaporation amount of the treatment liquid per an interval and the number of occurrences of interval from start of suspension to restart.

14. A photo-developing apparatus according to claim 11, wherein the controller activates the water supplier a plurality of times at a specified interval before the photo-developing is restarted.

15. A photo-developing apparatus according to claim 14, wherein the predicted evaporation amount is obtained based on a time of the specified interval.

16. A photo-developing apparatus according to claim 11, wherein the predicted evaporation amount is obtained based on a correspondence between an ambient humidity of the treatment tank and an evaporation amount of the treatment liquid.

17. A photo-developing apparatus, comprising:

a treatment tank which contains a treatment liquid;

a level sensor which detects a level of the treatment liquid;

a water supplier which supplies water into the treatment tank; and a controller which controls the water supplier, the controller activating the water supplier to supply water to a standard level of the treatment liquid in the treatment tank when the level sensor detects a fall in the level of treatment liquid from the standard level to a specified supply level while photo-developing is in operation, and activating the wafer supplier to supply an amount of water corresponding to a predicted evaporation amount of the treatment liquid before the photo-developing is restarted after being suspended;

said water supplier including a first water supplying portion which supplies water to the treatment tank when the photo-developing is in operation, and a second water supplying portion which supplies water to the treatment tank before the photo-developing is restarted after being suspended.

18. A method for supplying water to a treatment liquid, comprising:

supplying water to a treatment tank until a treatment liquid in the treatment tank reaches a standard level when a fall in the level of treatment liquid from the standard level to a specified supply level is detected while photo-developing is in operation;

preparing a table which includes a predicted water evaporation amount of the treatment liquid per a specified time period under conditions in which photo-developing is suspended; and supplying an amount of water corresponding to the predicted evaporation amount of the treatment liquid in the table before the photo-developing is restarted after being suspended.

* * * * *